United States Patent [19]

Mann

[11] Patent Number: 4,752,148

[45] Date of Patent: Jun. 21, 1988

[54] DEPILATORY DISPENSER

[75] Inventor: Samuel J. Mann, Englewood, N.J.

[73] Assignee: Inverness Corporation, Fair Lawn, N.J.

[21] Appl. No.: 676,168

[22] Filed: Nov. 29, 1984

[51] Int. Cl.[4] ..... A45D 34/04; B05C 17/02

[52] U.S. Cl. ..... 401/208; 401/220; 401/195

[58] Field of Search ..... 401/208, 219, 220, 123, 401/139, 132, 209, 175, 215, 195

[56] References Cited

U.S. PATENT DOCUMENTS

| | | | |
|---|---|---|---|
| 449,233 | 3/1891 | Porter | 401/208 |
| 519,051 | 5/1894 | Terry | 401/220 X |
| 1,565,979 | 12/1925 | Bachrach | 401/219 |
| 1,934,552 | 11/1933 | Moore | 401/220 |
| 2,029,056 | 1/1936 | Carlson | 91/67.4 |
| 2,511,379 | 6/1950 | Schwartzberg | 401/123 X |
| 2,716,251 | 8/1955 | Pearce | 401/139 |
| 3,048,880 | 8/1962 | Slomon | 401/220 |
| 3,083,397 | 4/1963 | Thomas | 401/220 |
| 3,100,908 | 8/1963 | Engle | 401/220 |
| 3,103,224 | 9/1963 | Dearling | 401/123 |
| 3,235,900 | 2/1966 | Klassen | 401/175 |
| 3,263,265 | 8/1966 | Judson | 401/269 |
| 3,284,839 | 11/1966 | Cook | 401/208 X |
| 3,351,969 | 11/1967 | Cline | 401/139 X |
| 4,127,339 | 11/1978 | Malacheski et al. | 401/132 |
| 4,150,904 | 4/1979 | Stewart | 401/219 |
| 4,168,128 | 9/1979 | Fillmore et al. | 401/213 |

FOREIGN PATENT DOCUMENTS

| | | | |
|---|---|---|---|
| 183911 | 11/1955 | Austria | 401/208 |
| 1965879 | 7/1971 | Fed. Rep. of Germany | 401/215 |
| 2164430 | 7/1973 | Fed. Rep. of Germany . | |
| 985064 | 3/1951 | France | 401/208 |
| 1003948 | 3/1952 | France | 401/220 |
| 2041484 | 1/1971 | France . | |
| 2467786 | 5/1981 | France | 401/1 |
| 2499518 | 8/1982 | France . | |
| 405901 | 2/1934 | United Kingdom | 401/215 |
| 992127 | 5/1965 | United Kingdom . | |
| 997630 | 2/1982 | United Kingdom . | |
| 2082124 | 3/1982 | United Kingdom | 401/209 |
| 2113994 | 8/1983 | United Kingdom . | |
| 0046038 | 2/1986 | United Kingdom . | |

*Primary Examiner*—Steven A. Bratlie

*Attorney, Agent, or Firm*—Blum Kaplan

[57] ABSTRACT

A depilatory dispenser for storing a depilatory therein and for dispensing a depilatory to a human's skin to facilitate hair removal is provided. A roller is provided in a dispensing head and is adapted to receive a depilatory that is stored in a reservoir. The roller includes radial ribs spaced apart to permit effective traction as the depilatory is dispensed and permit a uniform layer of film to be applied to the skin's surface.

12 Claims, 3 Drawing Sheets

DEPILATORY DISPENSER

BACKGROUND OF THE INVENTION

This invention is directed to a depilatory dispenser and, in particular, to a depilatory dispenser head for facilitating the application of a depilatory creme to the skin's surface.

It has been found in recent years that chemical depilatories, when applied to the hair, dissolves hair at the skin level. Nevertheless, applicators for applying depilatory cremes have been found to be ineffectual in applying a continuous film of depilatory creme to the skin's surface. For example, dispenser heads having a rolling ball have been developed but are unsatisfactory for two specific reasons. First, when using a ball, the ball and surrounding socket must be closely toleranced to prevent the ball from falling out of the socket. Because of the close tolerance the ball must be moved back and forth to prevent sealing. Back and forth movement causes the depilatory creme to be applied slowly, unevenly and in a very thin less effectual layer. Heretofore, no facile method or apparatus for storing and dispensing a depilatory creme has been provided. Accordingly, a depilatory dispenser that readily stores depilatory creme and dispenses the depilatory creme, in a fast and effective manner, permits easy hair removal and is disposable is desired.

SUMMARY OF THE INVENTION

Generally speaking, in accordance with the instant invention, a depilatory dispenser is provided. The dispenser includes a housing. The housing defines a reservoir for storing a depilatory therein. The housing further includes a dispensing head and a dispensing opening for permitting the depilatory to flow from the reservoir to the dispensing head. A roller, having raised radially disposed and spaced apart ribs, is disposed in the dispensing head for rolling on a depilatory to a human's skin when the depilatory flows from the reservoir through the dispensing opening onto the roller.

Accordingly, it is an object of this invention to provide a dispenser for storing and dispensing a depilatory.

A further object of the instant invention is to provide a disposable roll-on depilatory dispenser.

Still a further object of the instant invention is to provide a depilatory dispenser for storing and dispensing depilatory and for applying a depilatory to a human's face, body or limbs for effecting clean, efficient and safe hair removal.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 2:
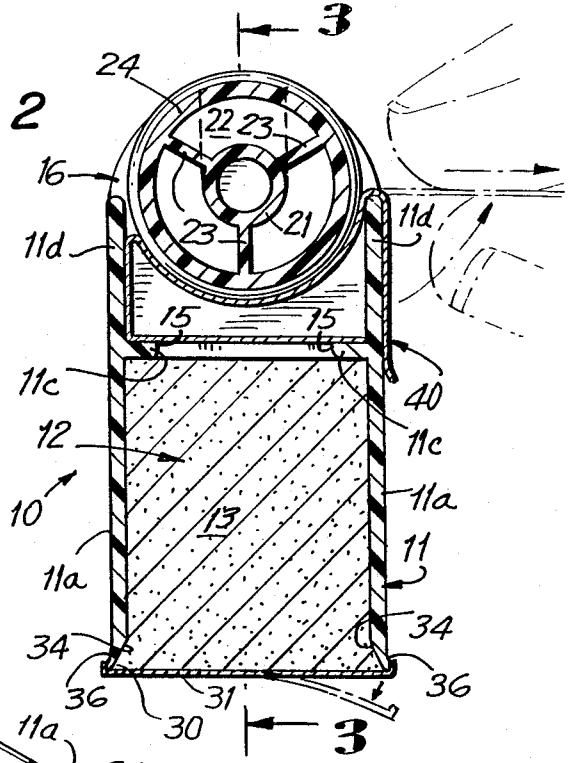
FIG. 2 is a sectional view taken along line 2—2 of FIG. 1.
Figure 1:
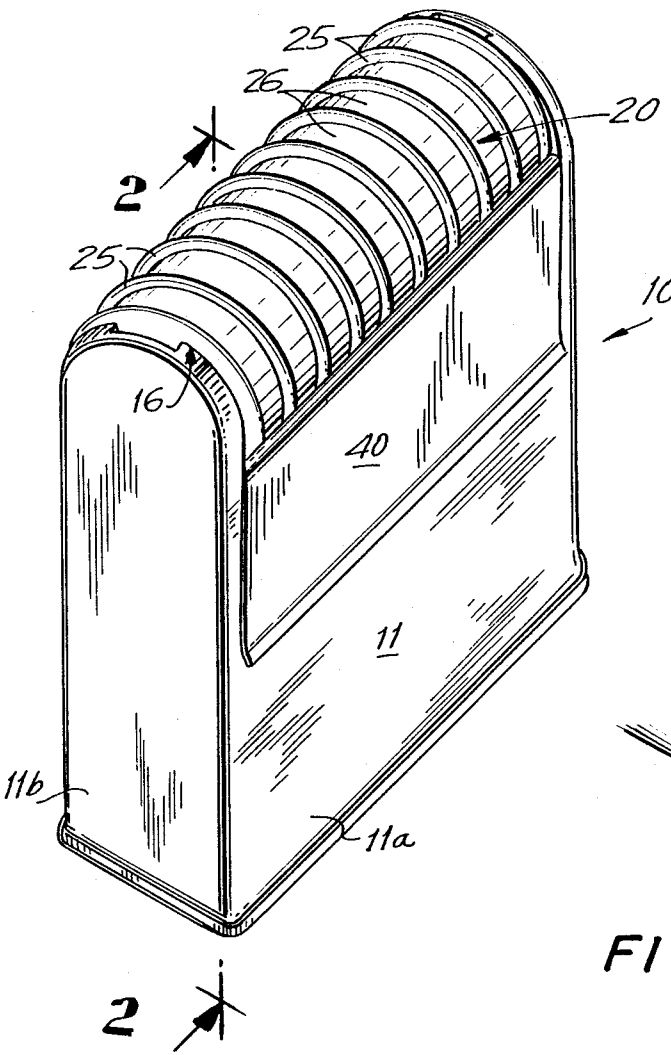
FIG. 1 is a perspective view of a depilatory dispenser constructed in accordance with a first embodiment of the instant invention.
Figure 3:
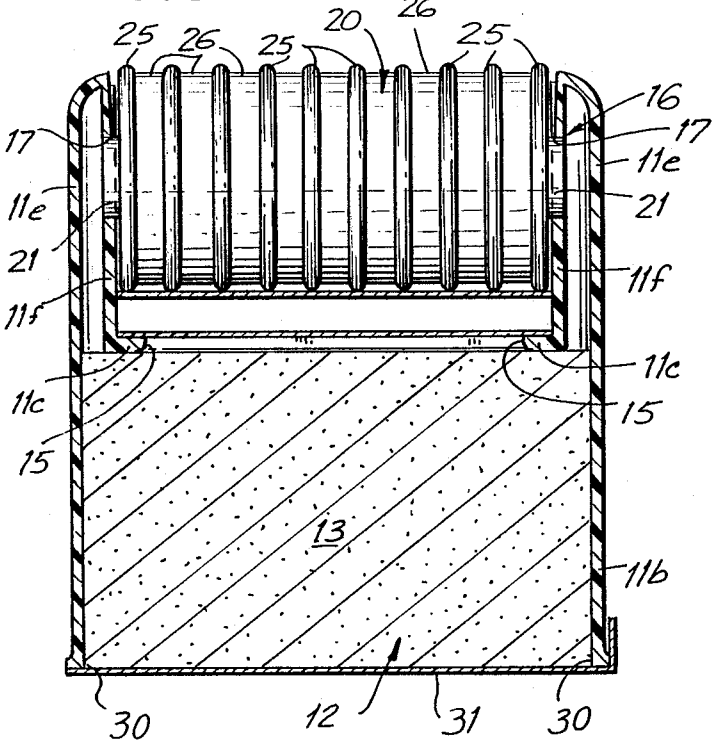
FIG. 3 is a sectional view taken along line 3—3 of FIG. 2.

Reference is first made to FIGS. 1 through 3 wherein a depilatory dispenser, generally indicated at 10, is depicted. Dispenser 10 includes a housing generally indicated as 11, supporting a roller, generally indicated as 20.

Housing 11 includes first lengthwise spaced apart walls **11*a* and transverse walls 11*b*, which walls define a reservoir, generally indicated as 12, for storing a depilatory creme 13, lotion or other flowable depilatory wherein. A dispensing opening 15 is defined by wall 11*c* of the housing, which wall extends from both the lengthwise walls 11*a* and the lateral walls 11*b*** of the housing.

Housing 11 further forms a dispensing head, generally indicated at 16, which is formed by lengthwise side walls **11*d* and transverse upright end walls 11*e*. Transverse upright walls 11*e* and lengthwise walls 11*d* are an extension of transverse walls 11*b* and lengthwise walls 11*a*, respectively, and merely extend these walls past the dispensing openings 15. The dispensing head is further defined by depending walls 11*f*, which walls meet the walls 11*c* forming the dispensing opening 15. Furthermore, depending walls 11*f* have openings 17 formed therein for receiving a roller, generally indicated as 20**, so that said roller can roll freely.

Roller 20 includes an inner cylinder 21, support wall 22 and spokes 23 for supporting an outer cylinder 24. As is best illustrated in FIG. 3, inner cylinder 21 extends past the lengthwise extent of outer cylinder 24 and is positioned within the openings 17 formed in depending walls **11*f* of the housing 11 to thereby permit roller 20 to freely roll within dispensing head 16. Outer cylinder 24 includes a plurality of radial ribs 24, girdling the roller, each rib being spaced apart a predetermined distance from the next rib, to define a land 26 recessed therefrom. In an exemplary embodiment the distance of each land formed adjacent ribs 25** is on the order of 0.090 inches.

As is illustrated in FIG. 2, the distance between the outer diameter of the radial ribs 25 and lengthwise walls **11*d* is closely toleranced and is on the order of 0.008 inches to 0.016 inches. The clearance between lands 26 and walls 11*d* is on the order of 0.018 inches to 0.026 inches in order to define the thickness of the layer of depilatory flowing onto the skin surface. Radial ribs 25**, by reason of their small surface area and their close tolerance, remain relatively free of depilatory substance. When in use, the ribs serve as a tread providing contact and friction with the skin, causing the roller to revolve and thereby deposit a controlled uniform film of depilatory on the skin.

Housing 11 and roller 20 can be molded from any convenient moldable material. However, in an exemplary embodiment, it is preferred that the housing 11 be made of a material, such as ABS or polyethylene plastic, which is sufficiently dense and thick so as to prevent any degradation of the depilatory stored in the reservoir which could occur in time as a result of osmosis or absorption. Accordingly, the thickness of the walls 11*a*, 11*b* and 11*c*, defining the reservoir 12, can be on the order of 0.030 inches to 0.070 inches thickness. The above range of wall thicknesses have been found particularly effective in use with a depilatory having a formulation including: Deionized water; stearyl alcohol; ceteareth-20, mineral oil; clacium hydroxide; sodium thioglycolate; calcium thioglycolate and silica.

As is best illustrated in FIG. 2, walls 11*a* and 11*b* define an opening 30, which opening is closed by a flow seal 31. Flow seal 31 is formed of an aluminum foil coated with a polyethylene film. Seal 31 is heat sealed to housing 11 by having the polyethelene film weld itself to the housing walls 11*a* and 11*b* forming opening 30. Seal 31 is heat sealed to the housing walls 11*a* and 11*b* to close off the bottom of the reservoir 13 and thereby permit depilatory to be stored therein.

Figure 6:
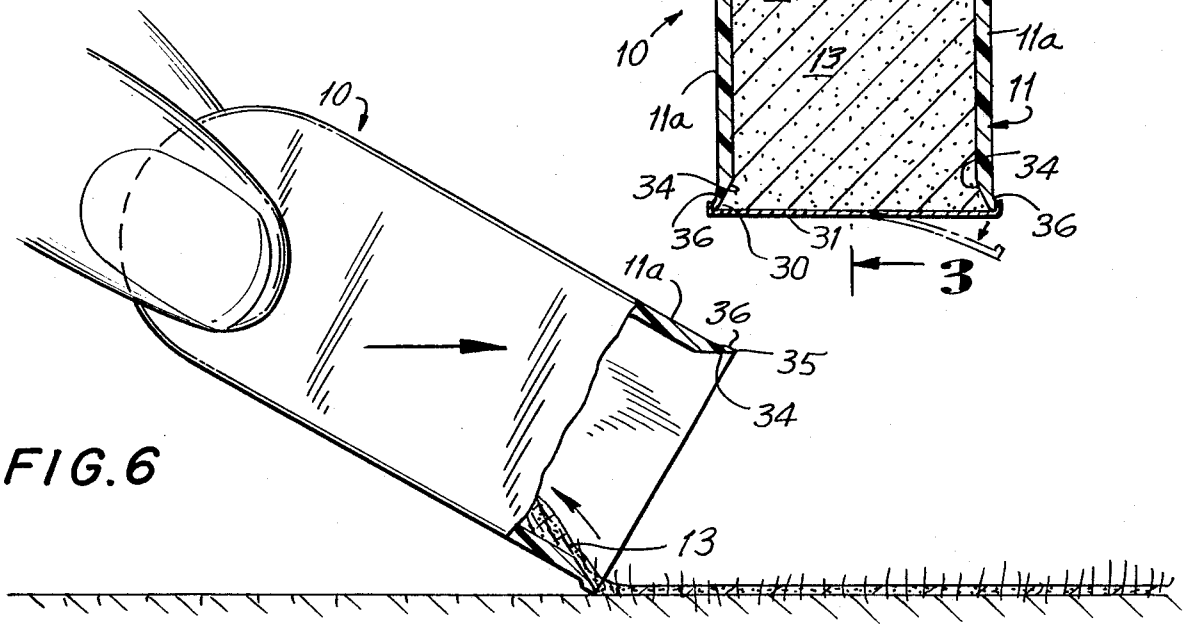
FIG. 6 is a partially removed elevational view illustrating a further part of the operation of the instant invention.

Reference is also made to FIG. 6 wherein an inside surface of lengthwise walls 11*a* are angled at 34 to define an edge 35 with the outer surface of wall 11*a*. Edge 35 is used for scooping off the depilatory and hair in a manner to be explained in greater detail below. Also, a radius 36 is included on the outer surface of wall 11a at or near the edge 35.

As aforenoted, depilatory 13 is stored in reservoir 12 which is formed by flow seal 31 and housing 11. The reservoir is further sealed for storage of the depilatory by dispensing seal 40, which seal is adapted to close off dispensing opening 15 and prevent the depilatory 13 stored in reservoir 12 from leaving the reservoir until the seal 40 is removed. In an exemplary emodiment, seal 40 is also formed of aluminum foil coated with a polyethylene film to permit seal 40 to be heat sealed to housing 11. Seal 40 is secured across dispensing opening 15 and along one of the upright walls 11*d* and is then folded back onto the outer surface of walls lid to create a hermetic seal which is constructed and arranged to be peeled away to permit the depilatory creme to be dispensed through dispensing opening 15.

The benefits of the depilatory dispenser of the instant invention are best understood by an explanation of the operation thereof. As illustrated in FIGS. 1, 2 and 3, after the depilatory dispenser 10 of the instant invention is completed, depilatory 13 is stored in the reservoir 12 of the housing 11. Releasable housing seal 40 and seal 31, together with the housing 11 define reservoir 12 and permit the depilatory to be stored in the dispenser during manufacture, shipping and storage.

Figure 4:
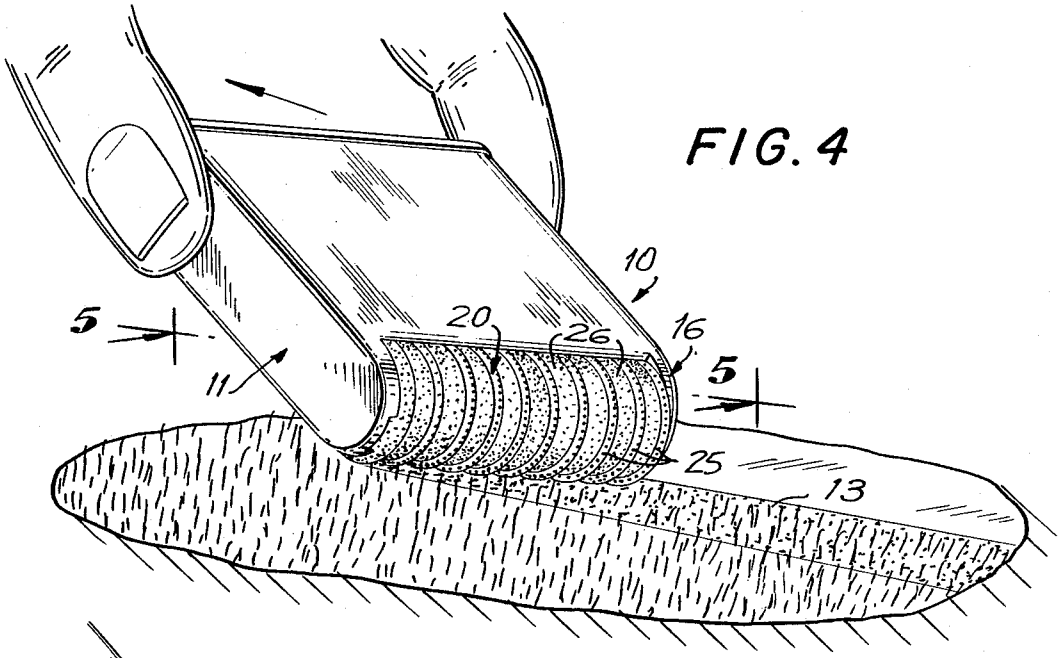
FIG. 4 is a perspective view illustrating part of the operation of the instant invention.
Figure 5:
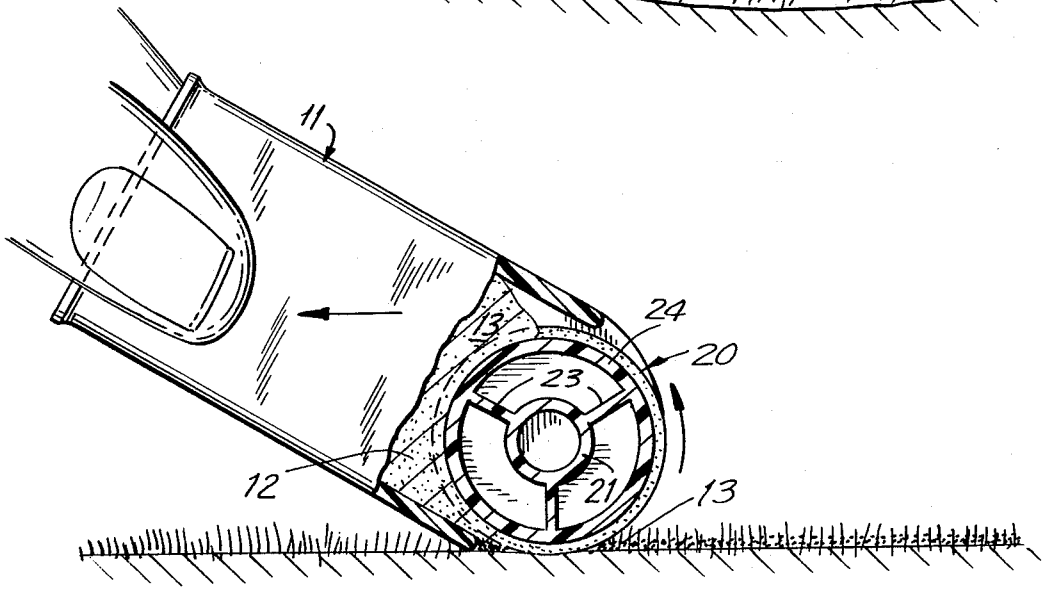
FIG. 5 is a sectional view taken along line 5—5 of FIG. 4.

For example, when it is desired to affect hair removal at or around the site of a surgical incision prior to a surgical procedure, the dispensing seal 40 is pulled in the manner illustrated in phantom in FIG. 2 in order to peel the seal away from dispensing opening 15. The dispenser is then turned upside down in order to bring the reservoir above the roller. Next, the flow seal 31 is either punctured with a pointed instrument or slightly peeled away. By puncturing or peeling away seal 31, the internal vacuum is broken, allowing atmospheric pressure to cause the depilatory to flow onto the roller and permit the roller to apply depilatory to the skin's surface in the manner illustrated in FIG. 4. As noted above, the roller not only applies the depilatory but, by reason of the configuration thereof affects a controlling metering of the thickness of the depilatory. Furthermore, the radial ribs on the roller serve as a tread to provide contact and friction with the skin's surface and cause the roller to revolve and in so doing to deposit a controlled uniform film of depilatory on the skin.

The depilatory is then left on the skin surface for approximately ten minutes, at which time its effect in dissolving and weakening the hair may be easily observed. Specifically, the hair begins to assume a curly or corkscrew appearance thereby indicating that the depilatory and the hair may be now be removed.

Next, the bottom seal 31 is fully removed, thereby exposing edges 35. The user is then able to position housing 11 flat on its respective sides on the skin's surface and to scrape the dispensed depilatory solution and removed hair into the previously emptied housing. Angled surface 34 provides a lead and edge and results in a highly efficient removal and transfer of the depilatory and hair from the skin into the container. External radius 36 provides a non-abrading edge to the skin to prevent exfoliation at the skin's surface. By avoiding an abrasion to the skin, the likelihood that an infection will not occur is substantially enhanced. Once the hair removal operation is completed, the entire housing can be disposed of thereby providing a highly effective, disposable roll-on depilatory dispenser.

The embodiment illustrated above in FIGS. 1 through 6 is particularly suitable for use in hair removal at or around the site of a surgical incision. Hair removal is deemed necessary prior to surgery because hair is known to be host to bacteria which thereby creates a potential for post-operative infection. For this purpose, use of the housing 11 to store the depilatory creme and disposal of the housing upon completion of use is most desireable. On the other hand, the use of depilatory cremes for cosmetic purposes requires the use of a larger reservoir for covering larger areas and to permit usage of the depilatory creme over several repeated uses over a period of time.

Figure 7:
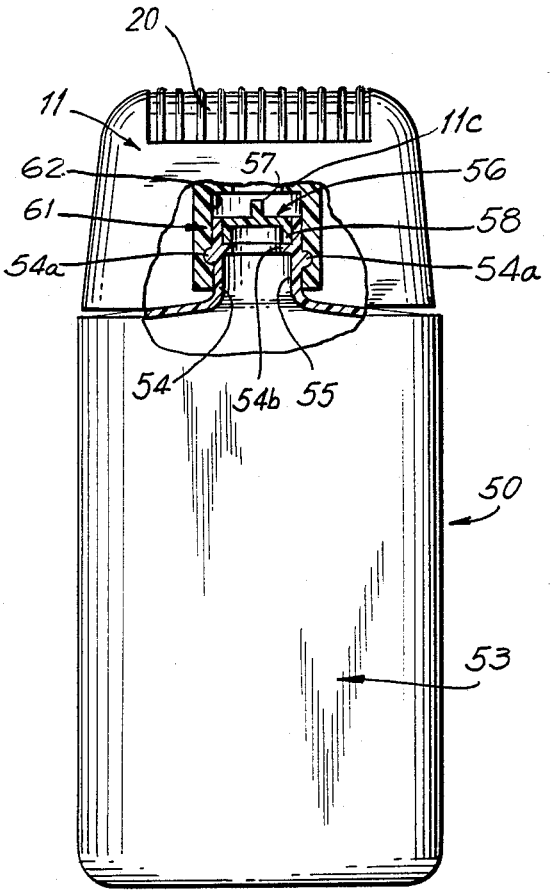
FIG. 7 is an elevational view of a depilatory dispenser constructed in accordance with a preferred embodiment of the instant invention.
Figure 8:
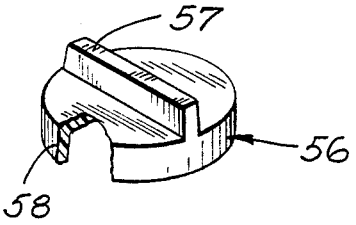
FIG. 8 is a cut-away perspective view of a plug used in accordance with the preferred embodiment depicted in FIG. 7.

Acordingly, reference is next made to FIGS. 7 and 8, wherein a depilatory dispenser 50, particularly suitable for home consumer use, is depicted, like reference numerals being utilized to denote like elements described above. Depilatory dispenser 50 includes a reservoir 53 of depilatory creme formed in the shape of a bottle having a neck 54 with threads 54*a* and a recessed annular shoulder 54*b* on the inner surface thereof, which neck defines an opening 55. During storage, shipping and point of sale, opening 55 is sealed off by a plug 56, which plug rests against annular shoulder 54*b* and seals off the opening 55 formed in the neck 54 to insure that the reservoir remains sealed during all storage and handling. Plug 56 includes a rib 57 disposed thereon which permits the consumer to remove the plug when the dispenser is adapted for normal usage and a depending annular wall 58 that provides a sufficient interference fit in neck 54 to seal off the reservoir during storage and handling.

Wall 11*c* of housing 11 includes a cap assembly 61, which cap assembly is adapted to be screwed onto the threads 54*a* of neck 54 of reservoir 53. The top of the cap assembly 61 includes an opening 62 therein to permit the depilatory creme to flow through opening 62 in cap assembly 61 onto the roller 20 and thereby permits free flow of the depilatory creme from the reservoir 53 to the roller head for easy application to the skin's surface in the same manner discussed above.

Accordingly, during storage, plug 56 remains secured in the threaded neck 54 of housing 50 to prevent leakage of the depilatory creme from the housing. When ready for use, the plug 56 is removed from the neck and cap assembly 61 is screwed onto the threaded bottle neck 55. The threads in cap assembly 61 and threads in bottle neck 54 are such as to assure that the head and reservoir are properly oriented after the housing assembly 11 has been secured tightly to the reservoir 53. The opening 62 in the cap assembly 61 is positioned in alignment with the opening 55 in bottle neck 54 to thereby assure that depilatory creme will be introduced onto the roller thereby permitting the roller to revolve and deposit a controlled uniform film of depilatory to the skin.

It is noted that a foil seal may be used in lieu of plug 56 to releasably seal reservoir 53. However, use of the removable plug permits the user to replace the plug after each usage and provides a depilatory dispenser that can be stored over long periods of time and reused when appropriate.

Accordingly, the instant invention is characterized by a depilatory dispenser having a ribbed roller for permitting a uniformly thick and continuous film of depilatory creme to be dispensed onto the skin's surface. By utilizing a roller having ribbed elements, the user is able to obtain a uniform flow of depilatory creme in long continuous layers. In particular, problems which are inherent to other applicators known in the prior art for depilatory cremes, such as a rolling ball, are eliminated. For example, the short back and forth motion required in order to dispense depilatory creme using a rolling ball is eliminated by use of the dispensing head of the instant invention. Thus, a fixed and controlled dispensing of depilatory creme in a sufficient film to effect dissolving of the hair is obtained by use of the dispensing head of the instant invention.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

I claim:

1. A depilatory dispenser comprising in combination a reservoir for storing a flowable depilatory therein, and a dispensing means in fluid communication with said reservoir, said dispensing means including a housing and a roller means, said housing and said roller means cooperating to effect a metering of said depilatory, said roller means having a substantially right cylindrical shape including essentially a plurality of raised spaced ribs distributed radially along the lengthwise extent of the substantially right cylindrically shaped roller means and a recessed land between each adjacent rib, the distance of each recessed land between each adjacent rib being greater than the lateral width of each of said ribs, each of said ribs being circumferentially disposed above said roller means in the direction of rotation for serving as a tread for providing contact and friction of the ribs against the skin's surface, said roller means being rotatable through an entire revolution when said roller means is moved along the skin's surface for delivering depilatory to the skin's surface, each of said ribs of said roller means being spaced in close tolerance on the order of 0.008 inches to 0.016 inches of said housing, the clearance between said lands and said surrounding housing being toleranced on the order of at least 0.018 inches so that a uniformly thick layer of depilatory is applied to the skin by said roller means.

2. A depilatory dispenser, as claimed in claim 1, wherein said reservoir includes an opening therein, and releasable sealing means disposed at said opening of said reservoir, said releasable sealing means preventing said depilatory from leaking from said reservoir.

3. A depilatory dispenser, as claimed in claim 2, wherein said housing includes a cap means, said cap means being adapted to engage and secure said housing to said reservoir at said opening of said reservoir so that said roller means is disposed in fluid communication with said depilatory stored in said reservoir when said releasable sealing means is released from said opening in said reservoir.

4. A depilatory dispenser, as claimed in clim 3, wherein said reservoir is a bottle having a neck, said neck including a threaded opening, and said cap means also including a threaded opening for permitting said housing to be screwed onto said neck of said bottle.

5. A depilatory dispenser, as claimed in claim 4, wherein said releasable sealing means is a plug, said plug being interference fit into said neck to thereby seal off the opening in said reservoir.

6. A depilatory dispenser, as claimed in claim 5, wherein said plug includes a rib for permitting said plug to be easily removed from said opening and replaced in said opening.

7. A depilatory dispenser, as claimed in claim 4, wherein said releasable sealing means is a foil seal.

8. A depilatory dispenser, as claimed in claim 2, wherein said releasable sealing means is a foil coated with a polyethylene film, said sealing means being impervious to said depilatory.

9. A depilatory dispenser, as claimed in claim 2, wherein at least a portion of said releasable sealing means is heat sealed about said reservoir opening.

10. A depilatory dispenser, as claimed in claim 9, wherein releasable sealing means includes a further extended portion thereof which extends external to said dispensing head, and is free of said housing to thereby permit said releasable sealing means to be easily gripped and removed from said reservoir opening.

11. A depilatory dispenser, as claimed in claim 1, wherein said housing defines a second opening, and at one wall of said housing includes an incline which meets the outer surface thereof to define a elongated edge for permitting said depilatory and hair to be scooped into said housing by said edge after application of said depilatory.

12. A depilatory dispenser, as claimed in claim 11, wherein the opposing surface of said wall having said incline includes an external radius at or about said edge for preventing abrading of the skin when said edge is used to scoop said depilatory and hair into said housing.

* * * * *